US009120613B2

(12) United States Patent
Ogura et al.

(10) Patent No.: US 9,120,613 B2
(45) Date of Patent: Sep. 1, 2015

(54) PACKAGE DEVICE FOR THIN DISPLAY DEVICE

(71) Applicant: Panasonic Intellectual Property Management Co., Ltd., Osaka (JP)

(72) Inventors: Motonari Ogura, Osaka (JP); Takayuki Michiyasu, Osaka (JP); Hisatoshi Shimose, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/104,119

(22) Filed: Dec. 12, 2013

(65) Prior Publication Data

US 2014/0097117 A1 Apr. 10, 2014

Related U.S. Application Data

(63) Continuation of application No. PCT/JP2013/000101, filed on Jan. 11, 2013.

(30) Foreign Application Priority Data

Jan. 17, 2012 (JP) ..... 2012-006697

(51) Int. Cl.
*B65D 81/127* (2006.01)
*B65D 81/05* (2006.01)

(52) U.S. Cl.
CPC ..... *B65D 81/127* (2013.01); *B65D 81/055* (2013.01); *B65D 81/057* (2013.01); *B65D 2585/6837* (2013.01)

(58) Field of Classification Search
CPC .... B65D 81/127; B65D 81/055; B65D 81/02; B65D 81/05; B65D 81/053; B65D 81/056
USPC ..... 206/521, 523, 586, 454, 453, 449, 588, 206/592
See application file for complete search history.

(56) References Cited

U.S. PATENT DOCUMENTS 6,092,651 A * 7/2000 Miller ..... 206/305
7,588,148 B2 * 9/2009 Yang ..... 206/523

(Continued)

FOREIGN PATENT DOCUMENTS

JP 2003-072845 3/2003
JP 2008-105683 5/2008

(Continued)

OTHER PUBLICATIONS

International Search Report issued Apr. 16, 2013 in International (PCT) Application No. PCT/JP2013/000101.

(Continued)

*Primary Examiner* — Steven A. Reynolds
(74) *Attorney, Agent, or Firm* — Wenderoth, Lind & Ponack, L.L.P.

(57) ABSTRACT

A package device has a packaging box and shock-absorbing members. The packaging box accommodates a display device main body with an exterior case that accommodates a display unit having a flat display panel and a drive circuit block. The shock-absorbing members are accommodated inside the packaging box so as to be disposed between the display main body and the packaging box at a top center and/or a bottom center. The shock-absorbing has first panel supporting parts that support the exterior case, and second panel supporting parts positioned on a display surface side of the display panel. The second panel supporting parts extend toward a center of the display panel from the first panel supporting parts so that gaps are formed between the display panel and the packing box. The shock absorbing members can effectively prevent damages to the thin display device due to mechanical shocks received during transportation.

5 Claims, 8 Drawing Sheets

(56) References Cited

U.S. PATENT DOCUMENTS

| | | | | |
|---|---|---|---|---|
| 7,690,508 | B2 * | 4/2010 | Maruta | 206/453 |
| 8,028,831 | B2 * | 10/2011 | Kakuta et al. | 206/320 |
| 8,215,484 | B2 * | 7/2012 | Lim | 206/320 |
| 8,777,009 | B2 * | 7/2014 | Nakase | 206/454 |
| 2006/0219596 | A1 * | 10/2006 | Lin et al. | 206/592 |
| 2009/0065385 | A1 * | 3/2009 | Kakuta et al. | 206/316.1 |
| 2009/0140963 | A1 | 6/2009 | Okumura et al. | |
| 2011/0049000 | A1 * | 3/2011 | Ishibashi | 206/521 |
| 2011/0210024 | A1 | 9/2011 | Tanaka et al. | |
| 2011/0308979 | A1 * | 12/2011 | Mitsuhashi | 206/320 |
| 2013/0248401 | A1 * | 9/2013 | Nakase | 206/454 |

FOREIGN PATENT DOCUMENTS

| | | |
|---|---|---|
| JP | 2009-139426 | 6/2009 |
| JP | 2010-030636 | 2/2010 |
| JP | 2010-274970 | 12/2010 |
| JP | 2011-178397 | 9/2011 |

OTHER PUBLICATIONS

International Preliminary Report on Patentability and Written Opinion of the International Searching Authority issued Jul. 31, 2014 in International (PCT) Application No. PCT/JP2013/000101.

* cited by examiner

PACKAGE DEVICE FOR THIN DISPLAY DEVICE

CROSS-REFERENCE TO RELATED APPLICATIONS

This is a continuation application of International Application No. PCT/JP2013/000101, with an international filing date of Jan. 11, 2013, which claims priority of Japanese Patent Application No.: 2012-006697 filed on Jan. 17, 2012, the content of which is incorporated herein by reference.

BACKGROUND

1. Technical Field

The present disclosure relates to a package device for a thin display device such as a liquid crystal display device and a plasma display device used as a television receiver and a monitor device.

2. Description of Related Art

Needs for liquid crystal display devices have been growing as professional-use as well as residential-use flat-type video display unit.

Generally, the liquid crystal display device is configured in such a manner that a backlight device as a surface light source is disposed on a back side of a flat liquid crystal display panel to configure a display module, and this display module is accommodated in a thin casing composed of a front cabinet and a back cabinet (see JP 2009-139426 A).

SUMMARY

This disclosure prevents damage to a thin display device due to mechanical shocks during transportation and the like.

The liquid crystal display devices have been made much thinner along with the popularization of a backlight device using LEDs. In view of outward appearance design, products of narrow frame design, in which a periphery of a front cabinet is narrowed as compared with an image display area, are increasing.

Since being made much thinner compared with conventional devices and adapting the narrow frame design, the liquid crystal display devices and other display devices (e.g., plasma display devices) tend to deteriorate in mechanical strength as a display. This causes a problem that the device is damaged by mechanical shocks during transportation.

The present disclosure has been accomplished in view of such circumstances and prevents a thin display device from being damaged by a mechanical impact during transportation and like.

The present disclosure provides a package device for a thin display device comprising: a packaging box configured to accommodate a display device main body which includes an exterior case accommodating a display unit, the display unit including a flat display panel and a driving circuit block for displaying an image on the display panel; and a shock-absorbing member accommodated together with the display device main body in the packaging box so as to be interposed between the display device main body and the packaging box at least at one of an upper central part and a lower central part of the packaging box, wherein the shock-absorbing member comprises, a first panel supporting part for supporting the exterior case of the display device main body, and a second panel supporting part which is disposed at a display surface side of the display panel and extends from the first panel supporting part toward a central part of the display panel leaving a gap from the display panel, wherein the second panel supporting part comprises a flat surface which is provided on the display surface side of the display panel and a projection provided on the packaging box side, and wherein both of the flat surface and the projection are disposed to at least partially cover the display surface of the display panel when the display panel is viewed from the front.

The present disclosure can effectively protect a thin display device against mechanical shocks during transportation and the like to prevent damage to a display panel.

DETAILED DESCRIPTION

A package device according to an embodiment of the present disclosure will be described with reference to the drawings by taking an example of a display module used for a liquid crystal display device. Excessively detailed description will be omitted if applicable. For example, detailed description of an already known matter and redundant description of essentially the same configurations will be omitted if applicable. This is for preventing the following description from being unnecessarily redundant, and for facilitating understanding of those who skilled in in the art. The present inventors provide the accompanying drawings and the following description for those skilled in the art to fully understand the present disclosure and do not intend to limit the subject matter defined in claims by the attached drawings and the following description.

Figure 1:
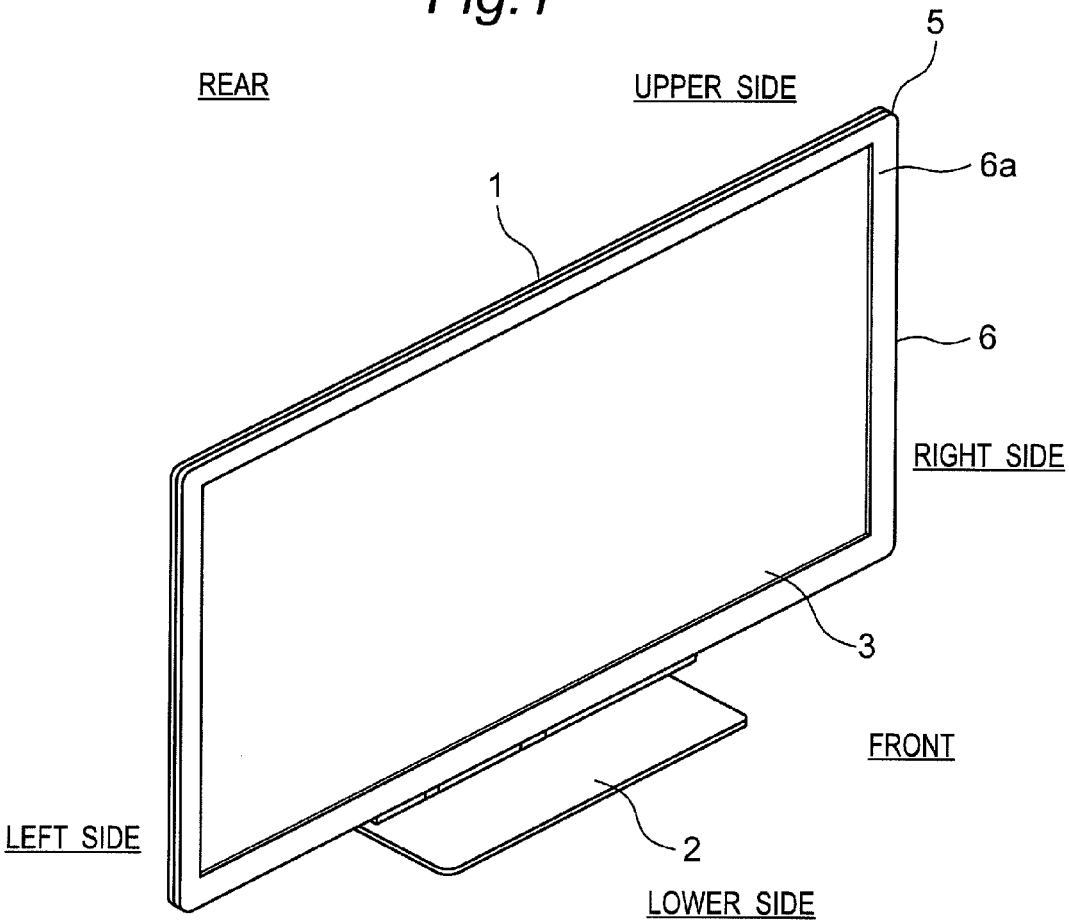
FIG. 1 is a perspective view showing outward appearance of a liquid crystal display device according to an embodiment of the present disclosure.
Figure 2:
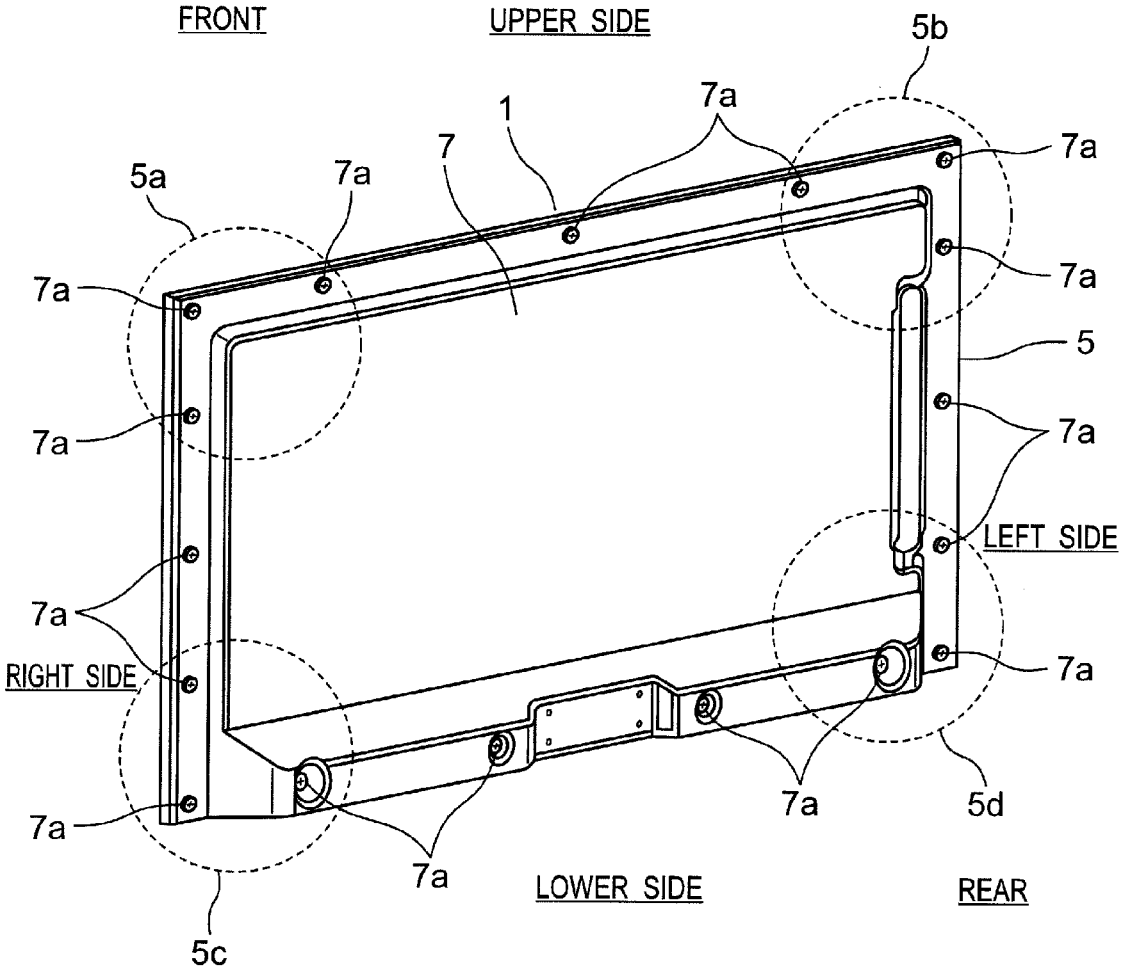
FIG. 2 is a perspective view of a rear of the liquid crystal display device which is detached from a stand.
Figure 3:
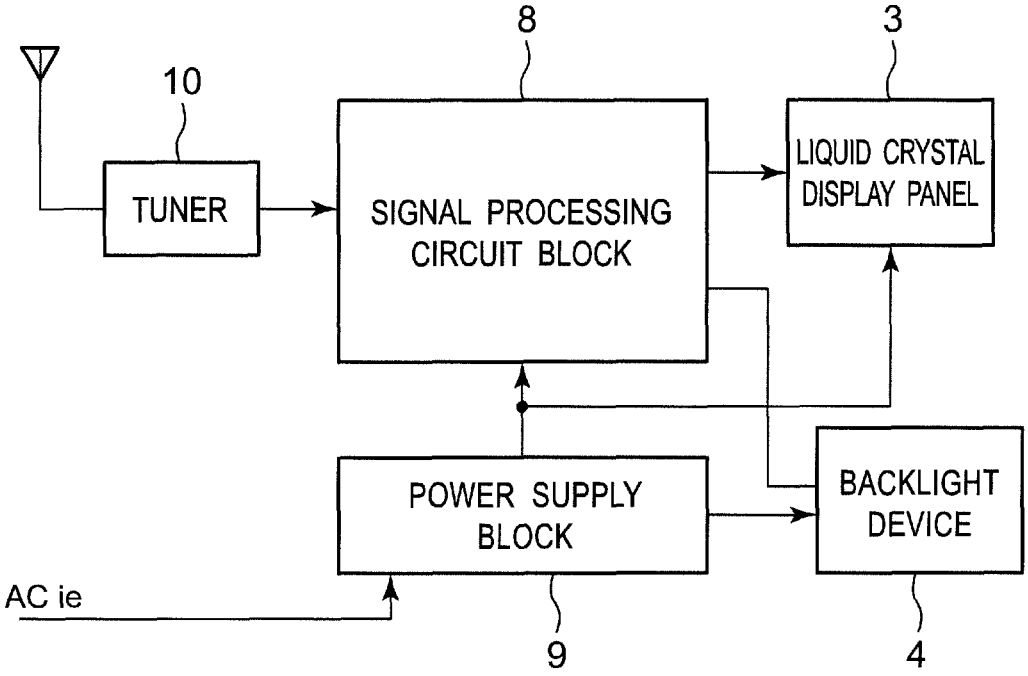
FIG. 3 is a circuit block diagram of an overall configuration of the liquid crystal display device.
Figure 4:
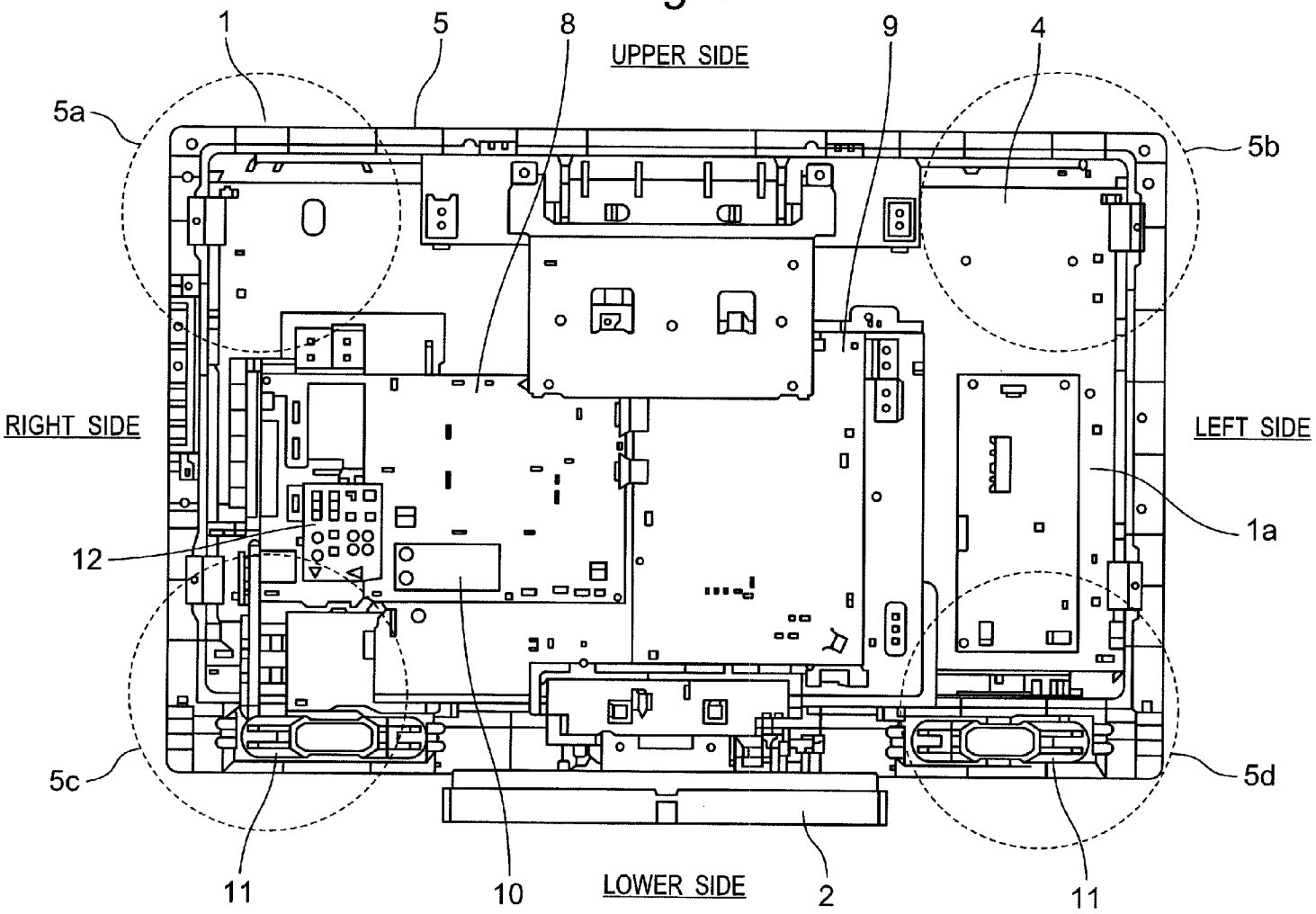
FIG. 4 is a rear view of the liquid crystal display device with a back cabinet removed for describing an exemplary arrangement of the circuit block.

FIGS. 1 and 2 are diagrams illustrating the appearance of a finished liquid crystal display device according to an embodiment of the present disclosure, FIG. 3 is a circuit block diagram of an overall configuration of the liquid crystal display device, and FIG. 4 is a diagram of the liquid crystal display device with a back cabinet removed for describing an arrangement example of the circuit block. In the following discussion, directions such as “upper side”, “lower side”, "left side", "right side", "front", and "rear" are based on the front view of a liquid crystal display panel 3 of the liquid crystal display device placed as in ordinary use as illustrated in FIG. 1.

As illustrated in FIGS. 1 and 2, the liquid crystal display device has a display device main body 1 and a stand 2 which holds the standing display device main body 1. A display unit 1*a* (see FIG. 4) of the display device main body 1 has a liquid crystal display panel (hereinafter, simply referred to as display panel) 3 which is a flat display panel, a backlight device 4, and a driving circuit block for displaying an image on the display panel 3. Together with the display unit 1*a*, components of devices which are included in the display device main body 1 are accommodated in an exterior case 5 which is made of resin molded products or the like. The exterior case 5 includes a front cabinet 6 which is provided with an opening part 6*a* corresponding to an image display area of the display panel 3 and a back cabinet 7 for covering the rear side of the display unit 1*a* in combination with the front cabinet 6. The back cabinet 7 of the exterior case 5 is attached to the display unit 1*a* with the periphery of the back cabinet 7 fastened to the display unit 1*a* by using screws. The back cabinet 7 of the exterior case 5 is attached to the display unit 1*a* with the back cabinet 7 fastened to the display unit 1*a* by the screwing parts 7*a* of the screws.

As illustrated in FIGS. 3 and 4, as a schematic configuration of the entire liquid crystal display device, a signal processing circuit block 8, a power supply block 9, a tuner 10, and a speaker 11 for outputting sound are provided in addition to a driving circuit for displaying an image on the display panel 3. The signal processing circuit block 8 has a light-emission control circuit for controlling light-emission of the backlight device 4. The power supply block 9 supplies source voltage to the display panel 3, the backlight device 4, and the signal processing circuit block 8. The tuner 10 receives television broadcast and supplies the received signal to the signal processing circuit block 8. The signal processing circuit block 8 and the power supply block 9 are made of components of circuits mounted to the circuit board, respectively. The circuit board having the signal processing circuit block 8, the power supply block 9, and the tuner 10 mounted on is attached to the rear side of the backlight device 4 in a room between the backlight device 4 and the back cabinet 7.

In FIG. 3, the speaker 11 is omitted. In FIG. 4, an external signal input terminal 12 for inputting a video signal from an external appliance such as a DVD player to the liquid crystal display device is mounted to the signal processing circuit block 8.

Figure 5:
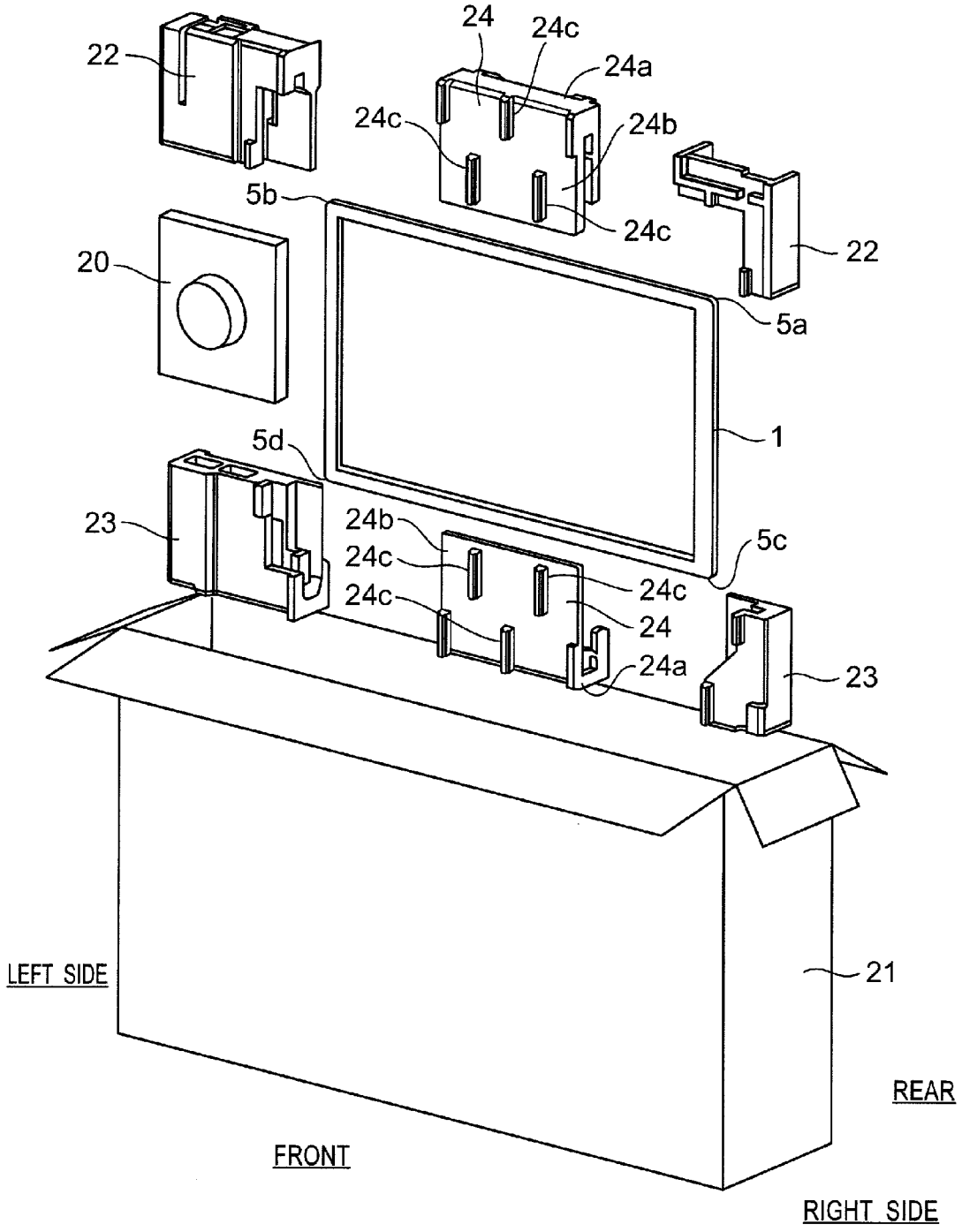
FIG. 5 is a perspective view illustrating a display device main body which is being packed in a packaging box by a package device according to the embodiment of the present disclosure.
Figure 6:
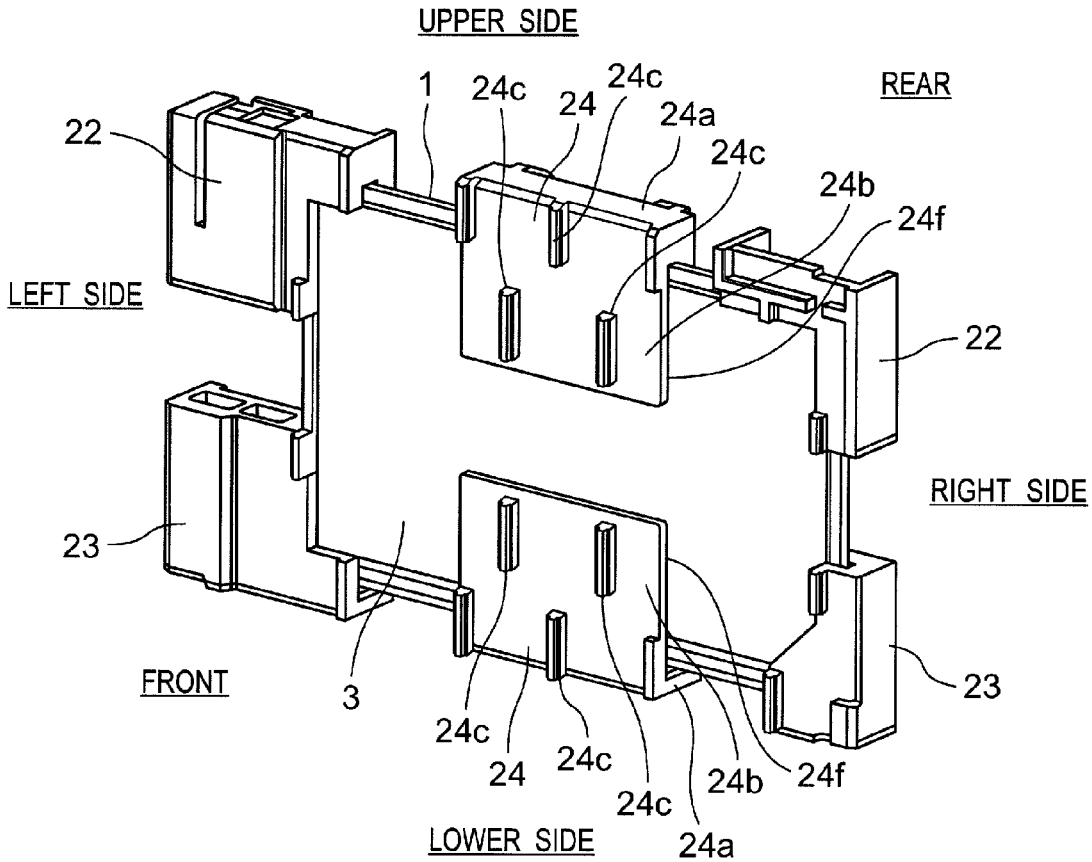
FIG. 6 is a perspective view illustrating positional relationship between the display device main body and shock-absorbing members.
Figure 7:
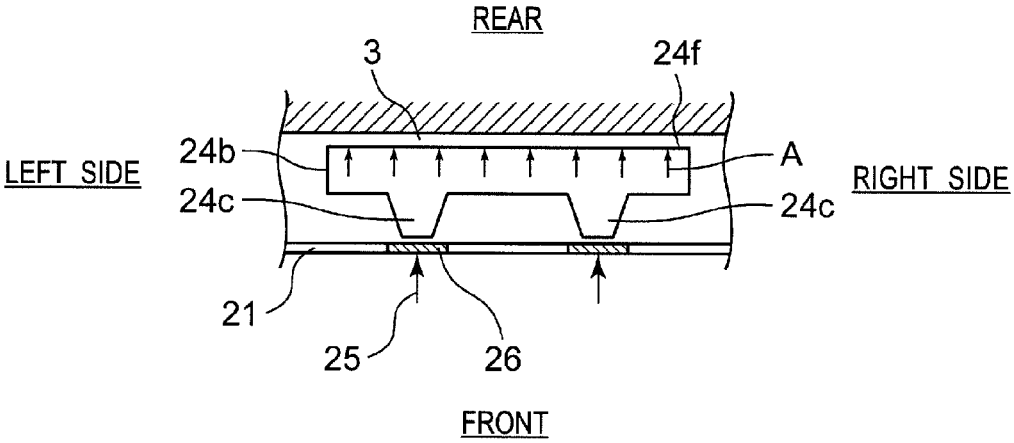
FIG. 7 is an illustration for describing an effect of the shock-absorbing member.

FIGS. 5 to 7 are diagrams for describing a package device for the liquid crystal display device according to the present disclosure. FIG. 5 is a perspective view illustrating the display device main body 1 being packed in a packaging box, FIG. 6 is a perspective view illustrating positional relationship between the display device main body and shock-absorbing members, and FIG. 7 is an illustration for describing an effect of a shock-absorbing member in a packed state.

As illustrated in FIGS. 5 to 7, the display device main body 1 is packed as it is covered with a multiwall sack (not shown) and accommodated in a packaging box 21 made of corrugated cardboard together with accessories 20 including a remote controller. Here, at the left and right corner parts of the upper part and the lower part of the packaging box 21, a pair of shock-absorbing members 22 for the upper corner parts and a pair of shock-absorbing members 23 for the lower corner parts are separately packed, respectively. Separately from the shock-absorbing members 22 and 23, shock-absorbing members 24 are disposed at the upper central part and the lower central part. The shock-absorbing members 22, 23, and 24 are made of materials having at least elasticity or shock-absorbing characteristics to some extent such as foaming polystyrene.

Upper and lower corner part regions 5*a*, 5*b*, 5*c*, and 5*d* of the exterior case 5 of the display device main body 1 are held by the shock-absorbing members 22 and 23 disposed at the upper part and the lower part of the packaging box 21 as illustrated in FIGS. 2, 4, and 6.

As illustrated in FIGS. 5 and 6, in the present disclosure, each of the shock-absorbing member 24 provided on a top panel side (top side) of the packaging box 21 and the shock-absorbing member 24 provided on a base side (bottom side) of the packaging box 21 has a first panel supporting part 24*a* which has a groove or a concave part for a portion of the exterior case 5 to be fit in. An upper end part and a lower end part of the display device main body 1 are supported by the first panel supporting parts 24*a* of these shock-absorbing members 24 at the central parts in the crosswise direction (right-left direction). The upper and lower shock-absorbing members 24 have sheets of second panel supporting part 24*b* which are disposed at a display surface side (front side) of the display panel 3 and extend from the first panel supporting part 24*a* toward a central part of the liquid crystal display panel 3. The second panel supporting part 24*b* has a base end side continuing from the first panel supporting part 24*a* and a tip side as a free end. In other words, the second panel supporting part 24*b* forms a kind of cantilever and is elastically supported against the first panel supporting part 24*a*. Further, the second panel supporting part 24*b* has a flat surface 24*f* on the display surface side (rear side) of the display panel 3. Also, the second panel supporting part 24*b* has projections 24*c* at the packaging box 21 side (front side) protruding toward the inside of the packaging box 21. In the present embodiment, the projection 24*c* is in an almost straight rib-like shape extending from the upper end part or the lower end part of the display device main body 1 toward the central part of the display panel 3 (vertical direction). In the usual cases where no load such as a mechanical shock is applied to the packaging box 21 from outside, a gap is left between the flat surface 24*f* and the display panel 3.

Now, as illustrated in FIG. 6, an effect in the case where the second panel supporting parts 24*b* with the projections 24*c* provided will be described with reference to FIG. 7.

As illustrated in FIG. 7, when a load (external load) 25 such as a mechanical shock is applied to the packaging box 21 from outside, the load is applied to the display panel 3 through the flat surface 24*f* of the second panel supporting part 24*b* as it is dispersed as denoted by arrows A. In the present disclosure, the projections 24*c* of the second panel supporting part 24*b* are crushed under the external load 25, so that stress concentration occurs on the parts where the tips 26 of the projections abut against the packaging box 21. That reduces the load due to the stress concentration to be applied to the display panel 3 side via the second panel supporting part 24*b*. That is, since the projections 24*c* are provided, the load to be applied from the flat surface 24*f* of the second panel supporting part 24*b* to the display panel 3 is evenly dispersed in a more assured manner. That can prevent a heavy load from locally applied from the flat surface 24*f* to the display panel 3. As a result, damage to the liquid crystal panel 3 can be prevented.

Figure 8:
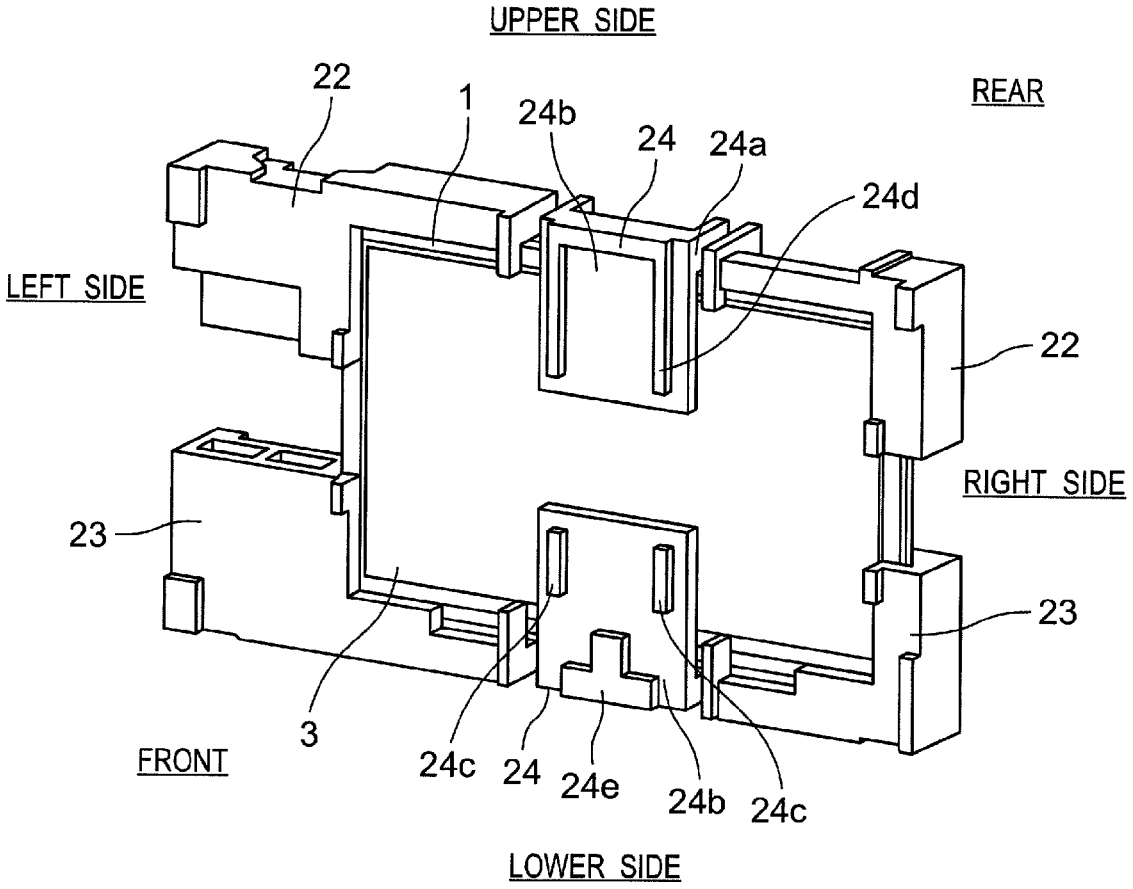
FIG. 8 is a perspective view illustrating positional relationship between the display device main body and the shock-absorbing members in the package device according to another embodiment of the present disclosure.
Figure 9:
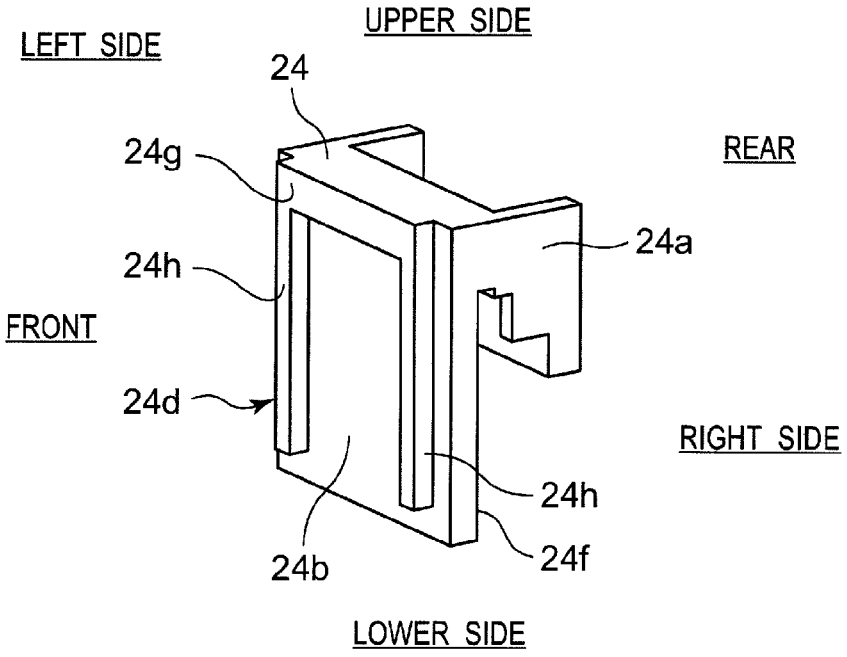
FIG. 9 is a perspective view illustrating the upper side center shock-absorbing member of the package device illustrated in FIG. 8.
Figure 10:
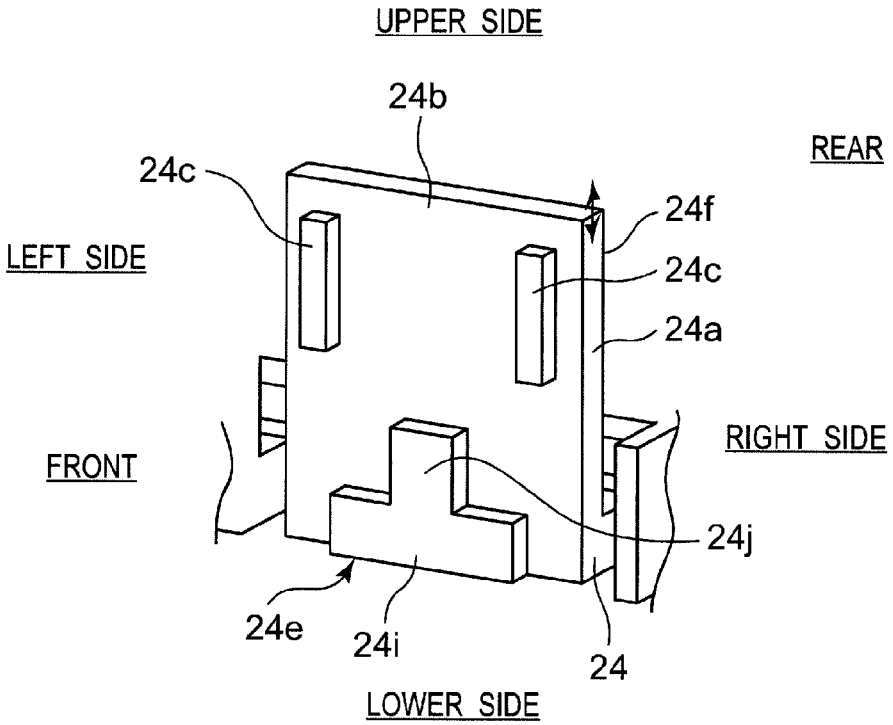
FIG. 10 is a perspective view illustrating the lower side center shock-absorbing member of the package device illustrated in FIG. 8.

FIGS. 8 to 10 are diagrams for describing the package device for the liquid crystal display device according to another embodiment of the present disclosure. FIG. 8 is a perspective view illustrating positional relationship between the display device main body and the shock-absorbing members, and FIGS. 9 and 10 are perspective views illustrating enlarged shock-absorbing members.

As illustrated in FIGS. 8 to 10, in the embodiment, the projections on the second panel supporting parts 24*b* of the shock-absorbing member 24 provided on the top panel side (top side) of the packaging box 21 and the shock-absorbing member 24 provided on the base side (bottom side) of the packaging box 21 have different shapes from those of FIG. 6.

Referring to FIG. 9, the shock-absorbing member 24 provided on the top panel side (top side) of the packaging box 21 has an almost inverted U-shaped projection 24*d* formed between the first panel supporting part 24*a* and the second panel supporting part 24*b*. Specifically, the projection 24*d* of FIG. 9 has a first portion 24*g* which extends in the crosswise direction (right-left direction) of the second panel supporting part 24*b* along the section of the second panel supporting part 24*b* connecting with the first panel supporting part 24*a*. The projection 24*d* of FIG. 9 has a pair of second portions 24*h* which extend downward from both ends of the first portion 24*f* toward the central part of the display panel 3.

Referring to FIG. 10, the shock-absorbing members 24 provided on the base side of the packaging box 21 include a pair of the projections 24*c* disposed in the right-left direction which are set adjacent to the right and left ends of the second panel supporting part 24*b*. Other than the projections 24*c*, a projection 24*e*, which looks like an inverted T when the display panel 3 is viewed from the front, is formed between the first panel supporting part 24*a* and the second panel supporting part 24*b*. Specifically, the projection 24*e* of FIG. 10 has a first portion 24*i* which extends in the crosswise direction (right-left direction) of the second panel supporting part 24*b* along the section of the second panel supporting part 24*b* connecting with the panel supporting part 24*a*. The projection 24*e* of FIG. 10 has a second portion 24*j* which extends upward from the central part in the crosswise direction of the first portion 24*i*.

Although the different projections are used for the shock-absorbing member 24 provided on the top panel side of the packaging box 21 and the shock-absorbing member 24 provided on the base side of the packaging box 21 in the example illustrated in FIGS. 8, projections in the same shape may be used for both of the shock-absorbing members 24.

Now, the functional effects in the case where the projections in the shapes illustrated in FIGS. 9 and 10 are formed will be described.

Recently, as the packaging members have become thinner, the shock-absorbing members have also become thinner. A thin shock-absorbing member tends to be warped in molding. In packing the thin display device, a warped shock-absorbing member may hamper the attachment of the shock-absorbing member of the top panel side or the insertion of the shock-absorbing member of the base side into the display device main body. Even though the shock-absorbing member is managed to be attached, when the second panel supporting part 24*b* is warped inward (both ends in the crosswise direction of the second panel supporting part 24*b* is warped to approach the display panel 3), the shock-absorbing member is left touching the display panel 3. In that case, the package may easily have a harmful effect on the display panel 3 caused by such a factor as vibration transmitted to the display panel 3 via the shock-absorbing member.

The projection 24*d* of FIG. 9 and the projection 24*e* of FIG. 10 have a first portions 24*g* and 24*i* which extend in the crosswise direction (right-left direction) of the second panel supporting part 24*b* along the section of the second panel supporting part 24*b* connecting with the panel supporting part 24*a*. The first portions 24*g* and 24*i* can function as ribs for reinforcing the first and second panel supporting parts 24*a* and 24*b* of the projections 24*d* and 24*e* to suppress deformation in molding the shock-absorbing member 24. Especially with these first portions 24*g* and 24*i*, inward warp of the second panel supporting parts 24*b* can be prevented.

As illustrated in FIG. 10, since the projections 24*c* are formed inward from the ends of the second panel supporting part 24*b*, the tips of the projections 24*c* are crushed by the shock under the load applied from the front but thin parts which are easily deformed are left at the ends of the second panel supporting parts 24*b*. When these thin parts touch the liquid crystal display panel 3, they exert a shock-absorbing effect so that they are capable of much more suppressing occurrence of the stress concentration on the display surface of the liquid crystal display panel 3.

As described above, the present disclosure provides an effect of making the thin display device much thinner while preventing damage to the panel due to mechanical shocks during transportation, even though narrow panel frame designs and thin packages are adopted and the mechanical strength of the thin display device is lowered.

Only either one of the shock-absorbing member 22 of the upper central part and the shock-absorbing member 24 of the lower central part may be adopted. In that case, the same effect of preventing damage to the panel can also be provided. In addition to the shock-absorbing members 22 and 24 of the upper central part and the lower central part, shock-absorbing members with the same structures as those of the shock-absorbing members 22 and 24 may also be disposed at the upper corner parts and the lower corner parts. Further, the shock-absorbing members with the same structures as those of the shock-absorbing members 22 and 24 may be disposed at the upper corner parts and the lower corner parts, and shock-absorbing members of general structure without the projections 24*c*, 24*d*, and 24*e* may be disposed at the upper central part and the lower central part. In those cases, the effect of preventing damage to the panel can also be provided.

As described above, the present disclosure is useful in preventing damage to a thin display device during transportation.

What is claimed is:

1. A package device for a thin display device comprising:

a packaging box configured to accommodate a display device main body which includes an exterior case accommodating a display unit, the display unit including a flat display panel and a driving circuit block for displaying an image on the display panel; and a shock-absorbing member accommodated together with the display device main body in the packaging box so as to be interposed between the display device main body and the packaging box at least at one of an upper central part and a lower central part of the packaging box, wherein the shock-absorbing member comprises:

a first panel supporting part for supporting the exterior case of the display device main body, and a second panel supporting part which is disposed at a display surface side of the display panel and extends from the first panel supporting part toward a central part of the display panel leaving a gap from the display panel, wherein the second panel supporting part comprises a flat surface which is provided on the display surface side of the display panel and a projection including a plurality of elements provided on the packaging box side, wherein both of the flat surface and the projection are disposed to at least partially cover the display surface of the display panel when the display panel is viewed from the front, wherein a concave portion is formed between the plurality of elements, and wherein at least one of the plurality of elements is entirely located over the display surface of the display panel when the display panel is viewed from the front.

2. The package device for a thin display device according to claim 1, wherein the projection has one end at a distance from a section of the second panel supporting part connecting with the first panel supporting part and extends from the end toward the central part of the display panel.

3. The package device for a thin display device according to claim 1, wherein the projection comprises:

a first portion which is provided along the section of the second panel supporting part connecting with the first panel supporting part, and a second portion which extends from the first portion toward the central part of the display panel.

4. The package device for a thin display device according to claim 3, wherein the second portion includes a pair of second portions extending from both ends of the first portion respectively.

5. The package device for a thin display device according to claim 3, wherein the second portion extends from the center of the first portion.

* * * * *